US009828753B2

(12) United States Patent
Bomatter et al.

(10) Patent No.: US 9,828,753 B2
(45) Date of Patent: Nov. 28, 2017

(54) INSERT FOR A SINK

(71) Applicant: Franke Technology and Trademark Ltd, Hergiswil (CH)

(72) Inventors: Christian Bomatter, Willer (FR); Rolf Neeser, Reidermoos (CH)

(73) Assignee: FRANKE TECHNOLOGY AND TRADEMARK LTD, Hergiswil (CH)

( * ) Notice: Subject to any disclaimer, the term of this patent is extended or adjusted under 35 U.S.C. 154(b) by 0 days.

(21) Appl. No.: 14/960,940

(22) Filed: Dec. 7, 2015

(65) Prior Publication Data

US 2016/0160485 A1 Jun. 9, 2016

(30) Foreign Application Priority Data

Dec. 5, 2014 (DE) ..... 20 2014 105 895 U

(51) Int. Cl.
*E03C 1/186* (2006.01)
*A47J 47/20* (2006.01)
*A47L 19/00* (2006.01)

(52) U.S. Cl.
CPC ..... *E03C 1/186* (2013.01); *A47J 47/20* (2013.01); *A47L 19/00* (2013.01)

(58) Field of Classification Search
CPC ..... E03C 1/186; A47J 47/20; A47L 19/00; A47L 19/02; A47L 19/04
USPC ..... 4/580–583, 654–657; 211/41.1–41.6; D32/55, 56, 57
See application file for complete search history.

(56) References Cited

U.S. PATENT DOCUMENTS 1,533,891 A * 4/1925 Oles ..... A47J 47/20 126/221
1,774,278 A * 8/1930 Kukulski ..... A47L 19/04 211/41.3
2,507,877 A 5/1950 Babcok
2,586,612 A 2/1952 Caldwell
5,295,589 A * 3/1994 Riepl ..... B62B 3/04 211/41.4
D363,577 S * 10/1995 Brightbill ..... D32/55
D594,263 S * 6/2009 Robbins, III ..... D6/582
D602,733 S * 10/2009 Huber ..... D7/388
(Continued)

FOREIGN PATENT DOCUMENTS

CH 253684 A * 3/1948 ..... A47J 47/20
DE 9215150 2/1993
(Continued)

OTHER PUBLICATIONS

Machine translation for FR 1095575.*

*Primary Examiner* — Erin Deery
(74) *Attorney, Agent, or Firm* — Volpe and Koenig, P.C.

(57) ABSTRACT

An insert (1) for a sink (6) is provided, having: a number of rod elements (2) which are arranged substantially parallel to and spaced apart from one another; a first flexible connecting arrangement (3) for connecting in each case first ends of the rod elements (2) with one another; a second flexible connecting arrangement (4) for connecting in each case second ends of the rod elements (2) with one another, which second ends are arranged opposite the first ends; and at least one through opening (5) is provided for interacting with an outlet (6*a*) of the sink (6), with the through opening (5) being arranged in one (4) of the connecting arrangements (3, 4).

15 Claims, 4 Drawing Sheets

(56) References Cited

U.S. PATENT DOCUMENTS

| | | | | |
|---|---|---|---|---|
| 8,087,108 | B2 | 1/2012 | Burns et al. | |
| D685,892 | S * | 7/2013 | Dickout | D23/290 |
| D773,142 | S * | 11/2016 | Green | D32/55 |
| 2008/0179264 | A1 * | 7/2008 | Abrams | A47L 19/02 211/41.3 |
| 2008/0263762 | A1 | 10/2008 | Burns et al. | |
| 2016/0206176 | A1 * | 7/2016 | Eilmus | A47J 47/20 |

FOREIGN PATENT DOCUMENTS

| | | | | |
|---|---|---|---|---|
| DE | 20305057 | | 8/2004 | |
| DE | 202014102174 | | 7/2014 | |
| FR | 1095575 | A * | 6/1955 | A47J 47/20 |
| GB | 676471 | A * | 7/1952 | A47J 47/20 |

* cited by examiner

Fig. 6
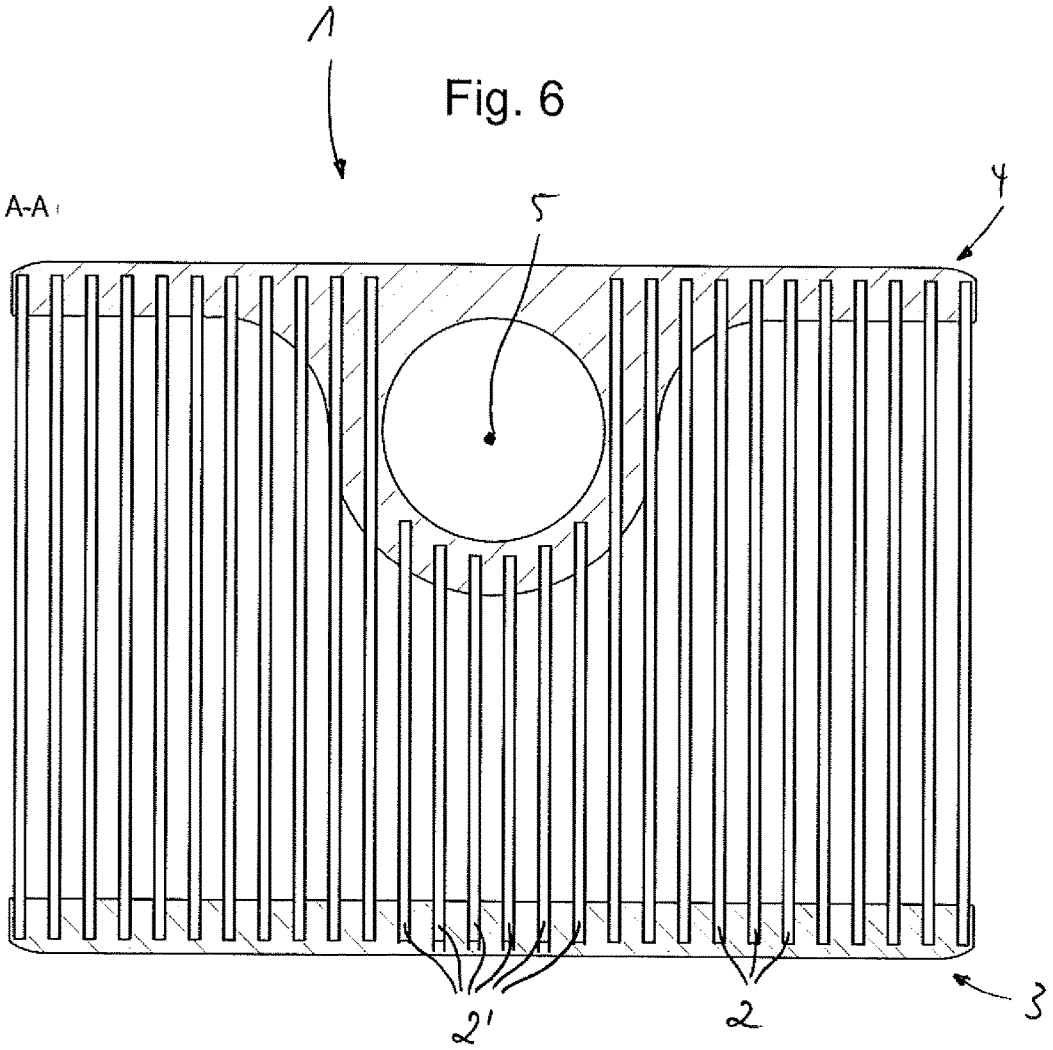
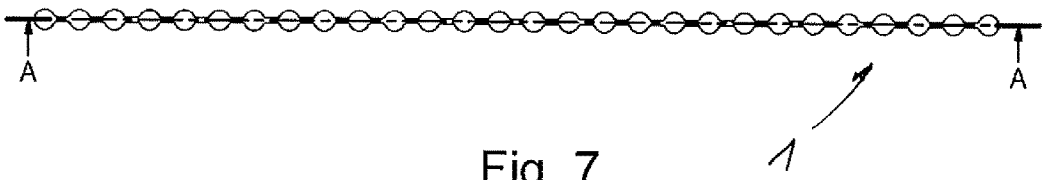
Fig. 7

INSERT FOR A SINK

INCORPORATION BY REFERENCE

The following documents are incorporated herein by reference as if fully set forth: German Patent Application No. DE 202014105895.8, filed Dec. 5, 2014.

BACKGROUND

The invention relates to an insert for a sink.

Providing sinks, in particular of kitchen sink units, with an insert in the form of a bottom grid produced from solid, stainless steel wire is known from the prior art.

These types of bottom grids are to be seen as disadvantageous consequently because when they are not being used, they are difficult to stow because they additionally have a relatively large own weight, and because they can additionally scratch the sink or sink unit.

SUMMARY

The object underlying the invention is to create an insert for a sink which can easily be stowed, comprises a lesser weight than known bottom grids, and additionally protects the sink unit material or the surface thereof.

The object is achieved by an insert for a sink with one or more features of the invention. Advantageous further developments of the invention are described below and in the claims.

An insert according to the invention for a sink comprises: a number of rod elements which are arranged substantially parallel to one another and at a spacing from one another; a first flexible connecting arrangement for connecting in each case first ends of the rod elements with one another; a second flexible connecting arrangement for connecting in each case second ends of the rod elements with one another, which second ends are arranged opposite the first ends; and at least one through opening which is provided for interacting with an outlet of the sink, which through opening is arranged in one of the connecting arrangements.

The insert according to the invention therefore comprises a number of rod elements which are flexibly connected to one another such that the entire insert is flexible, in particular is able to be rolled, and in this way is able to be stowed in a space-saving manner. The realization of the connecting arrangement produced from a flexible material can also ensure that the rod elements do not come into direct contact with the sink unit material such that said sink unit material is protected. Over and above this, in contrast with previously known bottom grids, the insert according to the invention dispenses with transversely arranged rod elements, which signifies a corresponding weight saving. The through opening provided in the case of the insert according to the invention ensures that an outflow of dishwater out of the sink is not obstructed in spite of using the insert according to the invention.

A first further development of the insert according to the invention provides that the through opening comprises a round cross section such that it matches the typically also round outlets of sinks in an optimal manner and does not impair the flow.

Another different further development of the insert according to the invention provides that a development of the relevant connecting arrangement is adapted at least in portions to an outside contour of the through opening. In this case, a development of the relevant connecting arrangement can be realized in a first portion and in a second portion parallel to the relevant ends of the rod elements and be adapted only in a central, third portion to the outside contour of the through opening, the named outside contour being realized in the named third portion preferably somewhat in the manner of a part circle. In this way, on the one hand the insert is developed in an aesthetically pleasing manner, on the other hand the described development of the connecting arrangement can have a favorable effect on the length of the rod elements used, which, in turn, has a favorable effect on the overall weight of the arrangement.

In the case of another further development of the insert according to the invention, it can be provided that the rod elements comprise substantially a same length at least in the first portion and in the second portion such that all in all a symmetrical development of the insert with reference to the through opening is produced.

In a corresponding manner, it can be provided in the course of another further development of the insert according to the invention that the rod elements in the third portion are realized shorter than the rod elements in the first portion and in the second portion. This corresponds to the fact that the through opening is also arranged in an advantageous manner in the third portion of the insert such that there the rod elements can be realized in a correspondingly shorter manner than in the first portion and in the second portion, which contributes to the weight saving addressed further above.

In a corresponding manner, another further development of the insert according to the invention provides that in the region of the through opening, in particular at least in parts of the named third region, the rod elements end on one side of the through opening, and that on a side of the through opening located opposite said side there are not any rod elements present.

For aesthetic as well as fluidic reasons, it is advantageous when the rod elements are spaced apart from one another at a substantially uniform, regular spacing. This also promotes the already-addressed rollability of the insert.

Yet another development of the insert according to the invention provides that the rod elements comprise an identical, preferably round cross section, which is also advantageous for aesthetic reasons and for reasons of rollability.

A preferred further development of the insert according to the invention provides that that the rod elements are realized in stainless material, preferably stainless steel. Particularly preferred in said connection is the use of the material having the number 1.4301 without the invention, however, being limited to the use of such a material. Metal material is not the only one to be considered—rather the rod elements can also be realized in a plastics material which is fiber-reinforced in a corresponding manner where applicable.

An extremely preferred further development of the insert according to the invention provides that the connecting arrangements are realized in a silicone material, preferably silicone elastomer or silicone rubber.

The addressed material combination (stainless steel and silicone) is particularly suitable for household and kitchen appliances. An antibacterial finish on the insert, in particular on the silicone, is obviously also considered.

In the case of another further development of the insert according to the invention, it can be provided that the respective ends of the rod elements are received or embedded in the relevant connecting arrangement or are surrounded by said connecting arrangement such that the rod elements end de facto in the respective connecting arrangement and are not visible from the outside. This contributes particularly to protecting the surface of the sink unit.

In addition, within the framework of another further development of the insert according to the invention, it can be provided that transversely with respect to a longitudinal direction of the rod elements, the connecting arrangements, between the rod elements, comprise a thickness which is smaller than the corresponding dimension of the rod elements themselves, in particular the diameter thereof. On the one hand this produces a material saving in the region of the connecting arrangements, which, on the other hand, accompanies further increased flexibility and improved rollability.

In addition, it can also be provided in the case of the insert according to the invention that the connecting arrangements and consequently the entire insert is realized so it is able to be rolled, preferably is able to be rolled up tightly, in a direction transversely with respect to a longitudinal direction of the rod elements, to which reference has already been made repeatedly. The insert is able to be stowed and stored in a particularly space-saving manner in this way.

Corresponding to the development of kitchen sink units, it can be provided in the case of another further development of the insert according to the invention that said insert is realized in particular in a rectangular manner in a rolled-out state. The invention is also in no way limited to inserts which are realized in such a manner. The corners of the insert can also be realized in a rounded, beveled or chamfered manner.

In addition, in the case of an insert according to the invention, the through opening can be arranged in an eccentric manner, in particular with reference to a shorter side of the (preferably rectangular overall) insert, which corresponds to the arrangement of outlets in the case of conventional kitchen sink units.

BRIEF DESCRIPTION OF THE DRAWINGS

Further characteristics and advantages of the invention are produced from the following description of exemplary embodiments by way of the drawing.

FIG. 6 shows a sectional view of the insert from FIG. 1;

FIG. 7 shows the position of the section according to FIG. 6; and

DETAILED DESCRIPTION OF THE PREFERRED EMBODIMENTS

Figure 1:
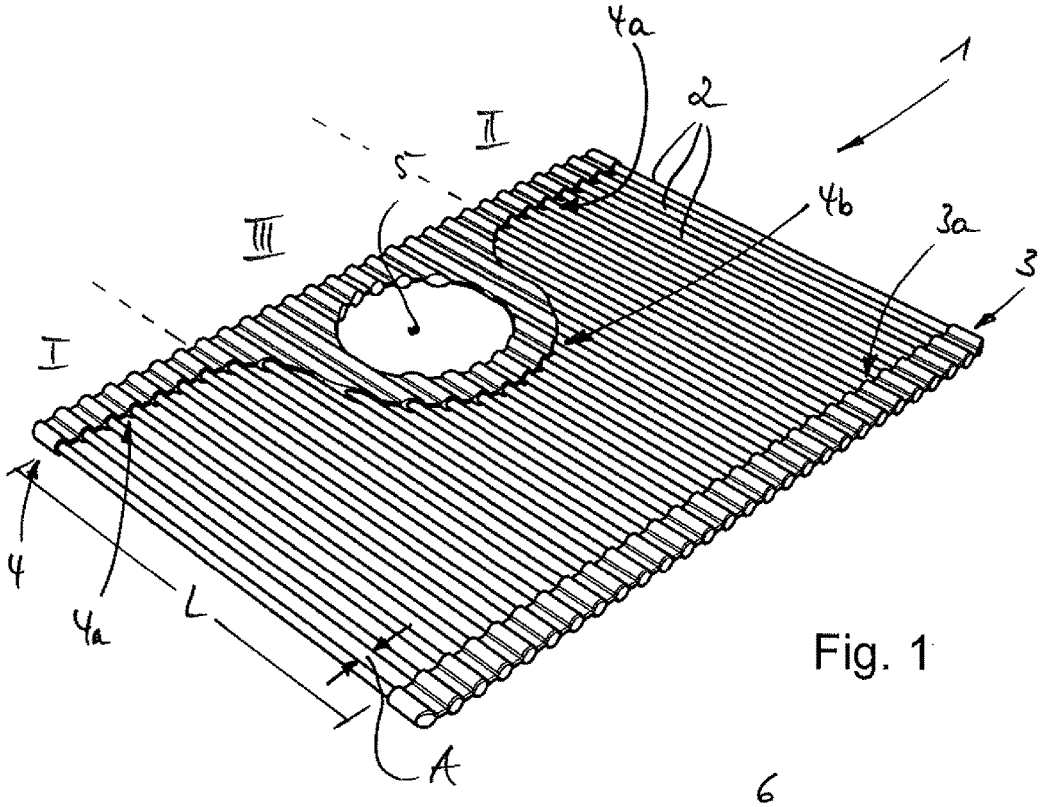
FIG. 1 shows an arrangement of the insert according to the invention in the rolled-out state.

FIG. 1 shows an insert or bottom roll mat according to the invention for a sink, which insert is designated as a whole by the reference 1. The insert 1 includes a number of rods or rod elements which are arranged substantially parallel to one another and at a spacing from one another, only a few of which rods being designated in FIG. 1 by the reference 2 for reasons of clarity. The individual rod elements 2 are connected together by means of a first flexible connecting arrangement 3 and by means of a second flexible connecting arrangement 4. As shown, the connecting arrangements 3, 4 serve for connecting respective first or second ends of the rod elements, which ends cannot be seen directly as such in FIG. 1 because they are received in the named connecting arrangements 3, 4. Definitively speaking, the first connecting arrangement 3 connects all ends of the rod element 2 together on one side of the insert 1, whilst the other connecting arrangement 4 connects the relevant ends of the rod elements 2 together on the other side of the insert 1.

In addition, the insert 1 includes at least one through opening 5 which is provided for interaction with the outlet of a sink (not shown here). Definitively speaking, this can mean that when the insert 1 is used in a sink, more details of which will be given further below, the named through opening 5 is arranged substantially exactly above the outlet of the sink. For this purpose, the through opening 5 can comprise substantially the same dimensions (diameter) as the addressed outlet of the sink. However, it is also possible for the through opening 5 to be realized with a correspondingly larger diameter such that it can be used with a plurality of sinks with different dimensions or different positions of the outlet.

According to the representation in FIG. 1, the through opening 5 is arranged in one of the connecting arrangements 3, 4, in the present case especially in the second connecting arrangement 4. Within the framework of the development shown, this is synonymous with the fact that the rod elements 1, proceeding from the first connecting arrangement 3, end in front of the through opening 5 in the region of the through opening 5 and—when seen from the connecting arrangement 3—are not continued behind the through opening 5.

In the exemplary embodiment shown, the through opening 5 comprises a round cross section. The rod elements 2 are formed of high-grade stainless steel (material 1.4301), and the connecting arrangements are realized in a silicone material. All the rod elements 2 comprise an identical, circular cross section. The rod elements 2 are spaced apart from one another at an identical, regular spacing which is designated in FIG. 1 by the reference A. Obviously, the invention is not limited to any of the aforementioned specifications.

In theory, the insert 1 can be divided into three portions or regions which are designated in FIG. 1 by Roman numerals I to III. In the first and second portion I, II, the rod elements 2 comprise substantially a same length L, the dimension shown between the connecting arrangements 3, 4 initially being understood here. The actual length of the rod elements 2 in the named portions is somewhat larger as they extend up to into the connecting arrangements 3 and 4 and are received therein. The rod elements 2 are realized in a shorter manner in the central portion III due to the realization of the through opening 5. Whilst the connecting arrangement 3 is realized with a straight inside edge 3*a*, the connecting arrangement 4 comprises a corresponding straight edge 4*a*, which extends parallel to the edge 3*a*, only in the portions I and II. In the central portion III, the inside edge 4*b* of the connecting arrangement 4, in contrast, is adapted at least in regions to an outside contour of the through opening 5, as shown. In this case, corresponding transition regions exist between the portions I and II and the portion III.

As already mentioned, the respective ends of the rod elements 2 are received or embedded in the relevant connecting arrangement 3, 4 and are consequently surrounded by said connecting arrangement such that that they can no longer be seen from the outside.

The entire insert 1 is realized overall in an approximately rectangular manner in the rolled-out state shown. In this case, the through opening 5 is arranged in an eccentric manner with reference to the shorter side of the named rectangular.

Figure 2:
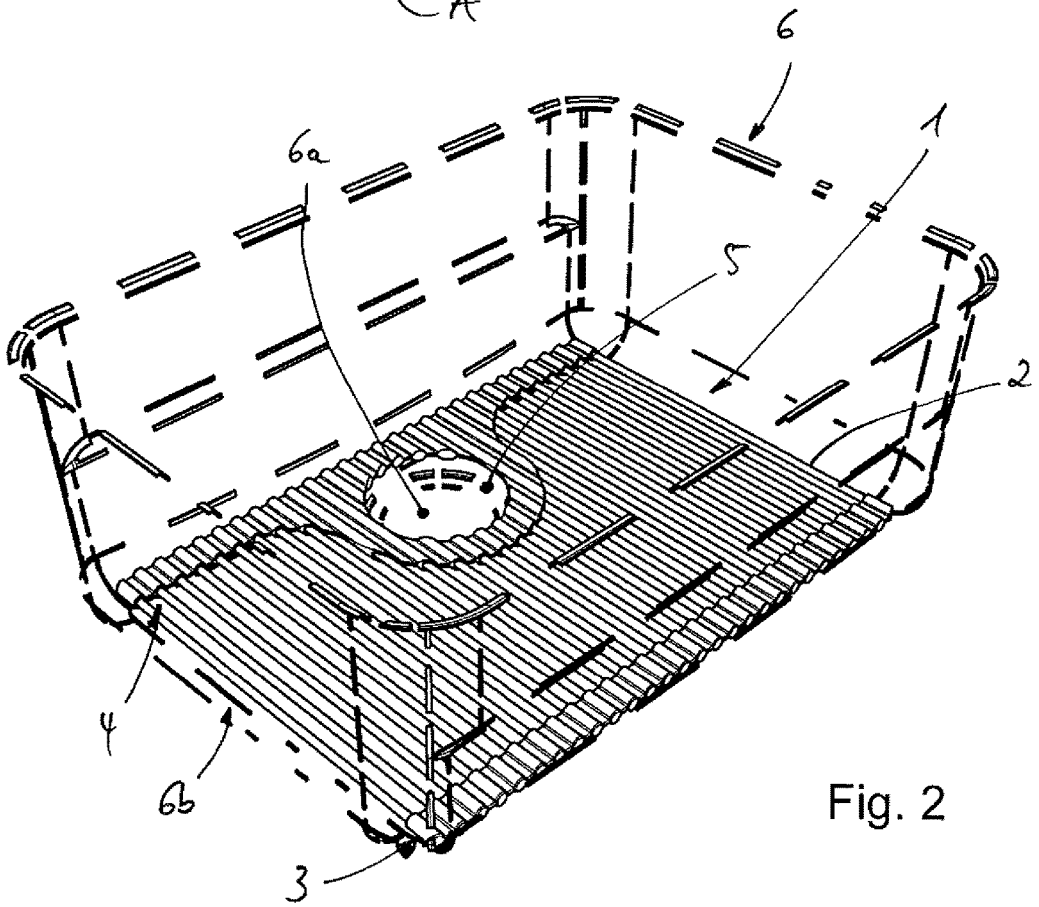
FIG. 2 shows the insert from FIG. 1 when being used in a sink.

FIG. 2 shows the insert or bottom roll mat 1 from FIG. 1 in its intended use as a bottom insert inside a sink, which sink is shown by the broken lines and is provided with the reference 6. Reference 6*a* designates the already mentioned outlet of the sink 6 which, in the present case, is arranged exactly below the through opening 5 of the insert 1, reference having already been made thereto. The insert 1 rests with the connecting arrangements 3, 4 in the region of the bottom 6*b* of the sink 6 and consequently ensures, on the one hand, that the sink material is protected and that the objects placed into the sink 6, such as dirty dishes and the like, are protected. In addition, its achievement is that there remains a (clear) space between the bottom 6*b* of the sink 6 and a bottom surface of the insert 1 or the rod elements 2, which is advantageous from a fluidic and hygienic viewpoint, for example in order to drain away contaminants below the insert 1 in the direction of the outlet 6*a* of the sink 6.

Figure 3:
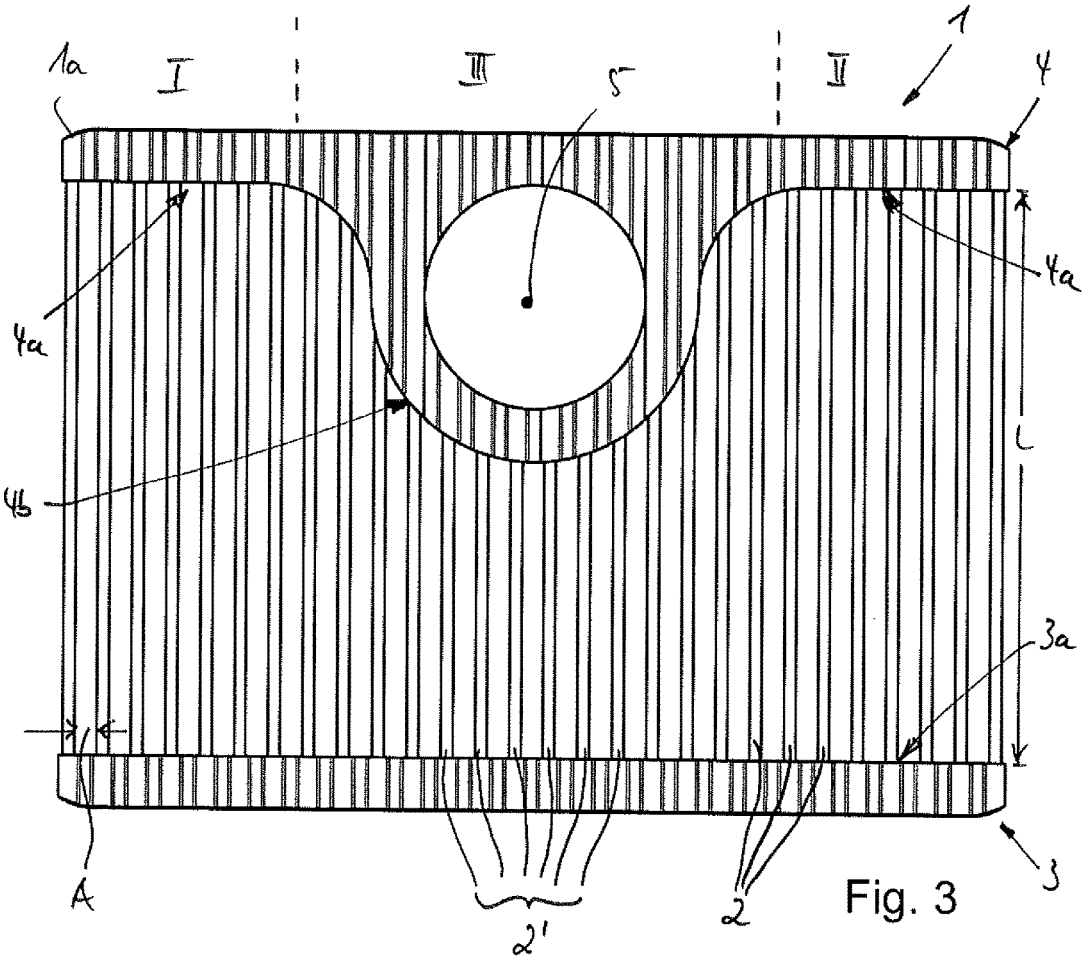
FIG. 3 shows a top view of the insert from FIG. 1.

FIG. 3 shows the top view of the insert 1 according to FIG. 1 again, there not being any need to provide more details thereof in the present case.

However, the rounded or beveled corners of the insert 1, which are designated as an example by reference 1*a*, have also to be emphasized.

As can also be seen well from FIG. 3, the connecting arrangement 4 is only adapted in regions to the outside contour of the through opening 5 in the region of the through opening 5 in the portion III, reference thereto having already been made: corresponding transition regions, in which in particular the curvature of the inside edge 4*b* changes in the direction of the inside edge 4*a*, are located in the transition to the adjacent portions I or II.

Whilst the rod elements 2, at least in the portions I and II and also in the portion III to the side of the through opening 5, are realized continuously, the rod elements designated by the reference 2' in FIG. 3, proceeding from the connecting arrangement 3, end in front of the through opening 5 and are realized in a shorter manner than the rest of the rod elements 2. Reference has already been made hereto further above. The rod elements 3 comprise substantially a same length L at least in the portions I and II. In contrast, the rod elements 2' in portion 3 are realized at least in part in a shorter manner.

Figure 4:
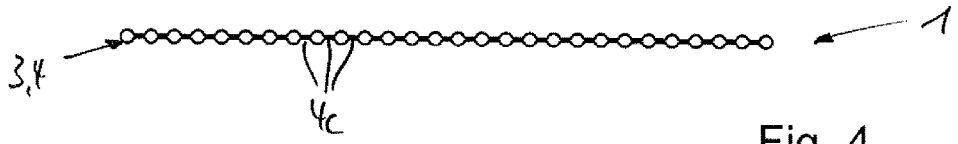
FIG. 4 shows a first side view of the insert from FIG. 1.

FIG. 4 shows a first side view of the insert 1 according to the previously described figures, in particular FIG. 1. As can be seen from FIG. 4, in those regions in which the rod elements 2, 2' (according to FIG. 3) are embedded, the insert 1 comprises or the connecting arrangements 3, 4 comprise a substantially circular cross section which is larger than in the intermediate regions, which intermediate regions are designated as an example in FIG. 4 by the reference 4*c*. The insert 1 is extremely flexible in this manner and is realized in particular so it can be rolled out, more details thereof are to be given further below in FIG. 6.

The essential fact in the representation according to FIG. 4 is, therefore, that, transversely with respect to the longitudinal direction of the rod elements, the connecting arrangements 3, 4, between the rod elements, comprise a thickness which is smaller than a corresponding dimension of the rod elements 2, 2', in particular the diameter thereof, or than a correspondingly larger dimension of the regions of the connecting arrangements 3, 4 which receive the ends of the rod elements 2, 2'.

Figure 5:
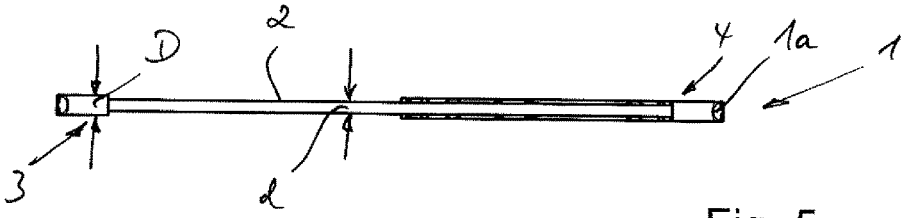
FIG. 5 shows a second side view of the insert from FIG. 1.

FIG. 5 shows another side view of the insert 1 according to FIGS. 1 to 3. As can be seen from the representation of FIG. 1, a thickness d of the rod elements 2 (and 2'; compare FIG. 3) is smaller than a thickness D of the connecting arrangements 3, 4. Reference has already been made hereto further above by way of FIG. 2.

FIG. 6 shows a sectional view according to the line A-A in FIG. 7. This illustrates the shorter realization of at least the rod elements 2' in the region of the through opening 5.

Figure 8:
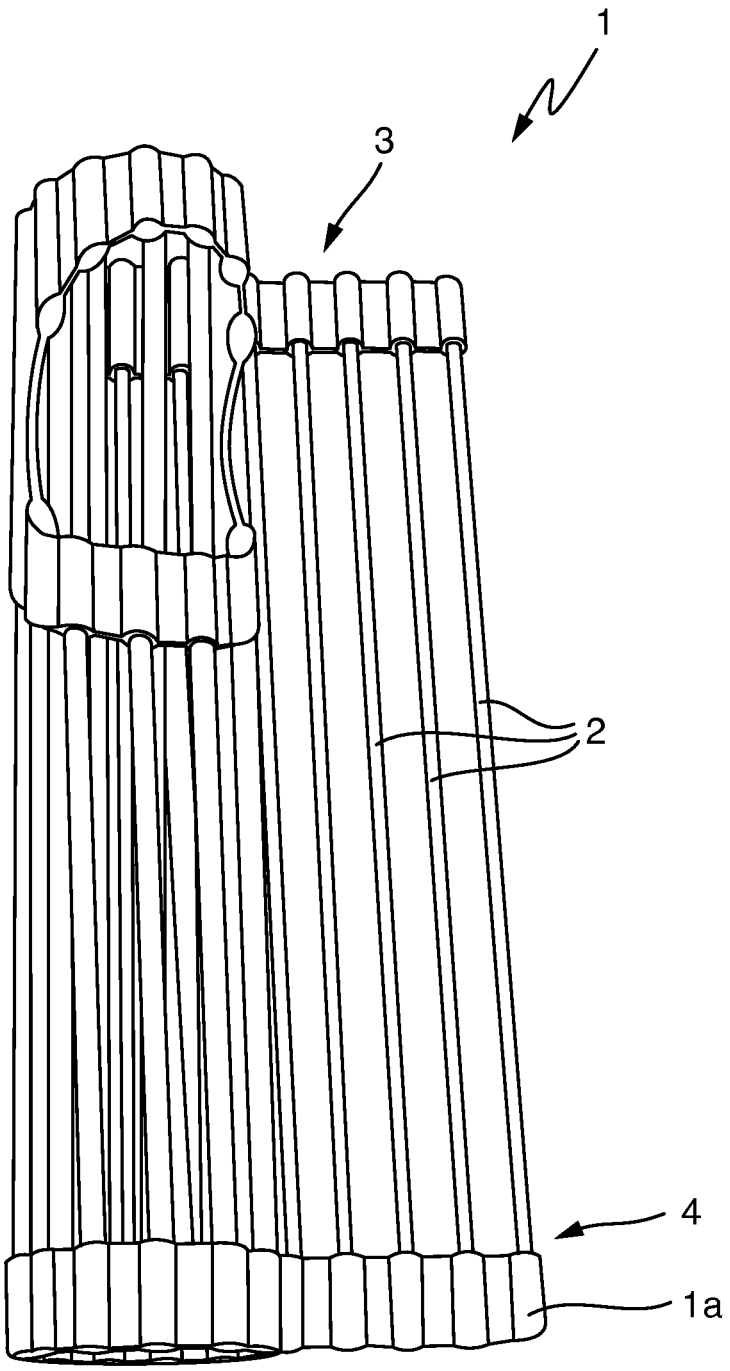
FIG. 8 shows the insert according to FIG. 1 in a partially rolled-up state.

Finally, FIG. 8 shows a representation of the described insert 1 in its (partially) rolled-out state. It is clear from this that an insert 1 according to the invention can easily be stowed in a very space-saving manner once it has been rolled up, as a result of which it differs from previously known, grid-like or rigid sink inserts.

The invention claimed is:

1. An insert (1) for a sink (6), comprising:

a plurality of rigid rod elements (2, 2') having first ends and second ends, the rod elements being arranged substantially parallel to and spaced apart from one another;

a first flexible connecting arrangement (3) for connecting the first ends of the rod elements (2, 2') with one another; a second flexible connecting arrangement (4) for connecting the second ends of the rod elements (2, 2') with one another, said second ends are arranged opposite the first ends; at least one through opening (5) which is provided for interacting with an outlet (6*a*) of the sink (6), said through at least one opening (5) is arranged in one (4) of the connecting arrangements (3, 4), wherein transversely with respect to a longitudinal direction of the rod elements (2, 2'), the connecting arrangements (3, 4), between the rod elements (2, 2'), comprise a thickness which is smaller than a thickness of the rod elements.

2. The insert (1) according to claim 1, wherein the through at least one opening (5) comprises a round cross section.

3. The insert (1) according to claim 1, wherein an outer contour of one of the connecting arrangements (4) corresponds, at least in portions (4*b*), to an outside contour of the at least one through opening (5).

4. The insert (1) according to claim 1, wherein the first connecting arrangement (3) comprises a straight inside edge (3*a*) and the second connecting arrangement (4) comprises first, second and third portions (I, II, III), the first and second portions (I, II) each have an inside edge (4*a*) that extends parallel to the straight inside edge (3*a*) of the first connecting element, and wherein the third portion (III) is arranged between the first and second portions (I, II) and has a contour which corresponds to an outer contour of the through at least one opening (5).

5. The insert (1) according to claim 4, wherein the rod elements (2) comprise substantially a same length (L) at least in the first portion (I) and in the second portion (II).

6. The insert (1) according to claim 1, wherein the rod elements (2, 2') are spaced apart from one another at a substantially uniform, regular spacing (A).

7. The insert (1) according to claim 1, wherein each of the rod elements (2, 2') are identical in cross section.

8. The insert (1) according to claim 1, wherein the rod elements (2, 2') are made of a stainless material.

9. The insert (1) according to claim 1, wherein the connecting arrangements (3, 4) are made of a silicone material.

10. The insert (1) according to claim 1, wherein the respective first and second ends of the rod elements (2, 2') are received or embedded in the respective first or second connecting arrangement (3, 4) or are surrounded by said first or second connecting arrangement.

11. An insert (1) for a sink (6), comprising:

a plurality of rigid rod elements (2, 2') having first ends and second ends, the rod elements being arranged substantially parallel to and spaced apart from one another;

a first flexible connecting arrangement (3) for connecting the first ends of the rod elements (2, 2') with one another; a second flexible connecting arrangement (4) for connecting the second ends of the rod elements (2, 2') with one another, said second ends are arranged opposite the first ends; at least one through opening (5) which is provided for interacting with an outlet (6*a*) of the sink (6), said through at least one opening (5) is arranged in one (4) of the connecting arrangements (3, 4), the first connecting arrangement (3) comprises a straight inside edge (3*a*) and the second connecting arrangement (4) comprises first, second and third portions (I, II, III), the first and second portions (I, II) each have an inside edge (4*a*) that extends parallel to the straight inside edge (3*a*) of the first connecting element, and the third portion (III) is arranged between the first and second portions (I, II) and has a contour which corresponds to an outer contour of the through at least one opening (5) wherein in the third portion (III) at least some of the rod elements (2, 2') are shorter than the rod elements (2) in the first portion (I) and in the second portion (II).

12. An insert (1) for a sink (6), comprising:

a plurality of rigid rod elements (2, 2') having first ends and second ends, the rod elements being arranged substantially parallel to and spaced apart from one another;

a first flexible connecting arrangement (3) for connecting the first ends of the rod elements (2, 2') with one another; a second flexible connecting arrangement (4) for connecting the second ends of the rod elements (2, 2') with one another, said second ends are arranged opposite the first ends; at least one through opening (5) which is provided for interacting with an outlet (6*a*) of the sink (6), said through at least one opening (5) is arranged in one (4) of the connecting arrangements (3, 4), the first connecting arrangement (3) comprises a straight inside edge (3*a*) and the second connecting arrangement (4) comprises first, second and third portions (I, II, III), the first and second portions (I, II) each have an inside edge (4*a*) that extends parallel to the straight inside edge (3*a*) of the first connecting element, and the third portion (III) is arranged between the first and second portions (I, II) and has a contour which corresponds to an outer contour of the through at least one opening (5), wherein in a region of the through opening (5), at least in part of the third portion (III), the rod elements (2') end on one side of the through at least one opening (4) and, on a side of the through opening (5) located opposite said one side, no rod elements are present.

13. An insert (1) for a sink (6), comprising:

a plurality of rigid rod elements (2, 2') having first ends and second ends, the rod elements being arranged substantially parallel to and spaced apart from one another;

a first flexible connecting arrangement (3) for connecting the first ends of the rod elements (2, 2') with one another; a second flexible connecting arrangement (4) for connecting the second ends of the rod elements (2, 2') with one another, said second ends are arranged opposite the first ends; at least one through opening (5) which is provided for interacting with an outlet (6*a*) of the sink (6), said through at least one opening (5) is arranged in one (4) of the connecting arrangements (3, 4) wherein the first and second connecting arrangements (3, 4) are rollable to allow the entire insert (1) to be rolled into a compact arrangement in a direction transversely with respect to a longitudinal direction of the rod elements (2, 2').

14. The insert (1) according to claim 13, wherein the insert has an overall rectangular shape in a rolled-out state.

15. The insert (1) according to claim 14, wherein the through opening (5) is arranged in an eccentric manner with reference to a side of the insert (1).

* * * * *